US009467782B2

(12) United States Patent
Oclee-Brown et al.

(10) Patent No.: US 9,467,782 B2
(45) Date of Patent: Oct. 11, 2016

(54) ELECTRO ACOUSTIC DIAPHRAGM

(71) Applicant: GP Acoustics (UK) Limited, Maidstone (GB)

(72) Inventors: Jack Anthony Oclee-Brown, Tonbridge (GB); Mark Alexander Dodd, Woodbridge (GB)

(73) Assignee: GP ACOUSTICS (UK) LIMITED, Maidstone (GB)

( * ) Notice: Subject to any disclaimer, the term of this patent is extended or adjusted under 35 U.S.C. 154(b) by 0 days.

(21) Appl. No.: 14/771,033

(22) PCT Filed: Feb. 19, 2014

(86) PCT No.: PCT/EP2014/053217
§ 371 (c)(1),
(2) Date: Aug. 27, 2015

(87) PCT Pub. No.: WO2014/131668
PCT Pub. Date: Sep. 4, 2014

(65) Prior Publication Data

US 2016/0014519 A1 Jan. 14, 2016

(30) Foreign Application Priority Data

Feb. 27, 2013 (GB) ..... 1303514.2
May 30, 2013 (GB) ..... 1309619.3

(51) Int. Cl.
*H04R 7/14* (2006.01)
*H04R 7/00* (2006.01)
(Continued)

(52) U.S. Cl.
CPC *H04R 7/14* (2013.01); *H04R 7/00* (2013.01); *H04R 7/02* (2013.01); *H04R 7/04* (2013.01)

(58) Field of Classification Search
CPC ..... H04R 7/00; H04R 7/02; H04R 7/04; H04R 7/12; H04R 7/14
See application file for complete search history.

(56) References Cited

U.S. PATENT DOCUMENTS 1,859,782 A * 5/1932 May ..... H04R 7/06 181/162
2,058,208 A 10/1936 Blattner
(Continued)

FOREIGN PATENT DOCUMENTS

DE 102007023512 A1 11/2008
GB 2055528 A 3/1981
(Continued)

OTHER PUBLICATIONS

International Search Report and Written Opinion issued for International Patent Application No. PCT/EP2014/053217, mailed May 16, 2014.
(Continued)

*Primary Examiner* — Matthew Eason
(74) *Attorney, Agent, or Firm* — Westman, Champlin & Koehler, P.A.; Z. Peter Sawicki; Amanda M. Prose

(57) ABSTRACT

A diaphragm for a loudspeaker, wherein the diaphragm is formed generally in a closed loop around a central void, the loop lying in a plane, the diaphragm having an axis in a direction orthogonal to the plane along which axis the diaphragm is arranged to be driven in use, the diaphragm having inner and outer circumferential edges which are adapted, in use, to be fixed in position, wherein a substantial portion of the diaphragm between the inner and outer edges is shaped in the direction of the said axis so as to protrude from the general plane of the diaphragm in either or both directions along the axis, and wherein said shaped portion when viewed along the direction of the axis comprises at least one series of curves extending radially across substantially all of the driven area of the diaphragm.

21 Claims, 3 Drawing Sheets

(51) Int. Cl.
*H04R 7/02* (2006.01)
*H04R 7/04* (2006.01)

(56) References Cited

U.S. PATENT DOCUMENTS 4,321,434 A * 3/1982 Irie ..... H04R 7/14 181/172
4,434,203 A * 2/1984 Briefer ..... G01L 9/0044 181/157
4,881,617 A * 11/1989 Faraone ..... H04R 7/14 181/164
6,320,970 B1 11/2001 Czerwinski et al.
6,535,612 B1 * 3/2003 Croft, III ..... H04R 19/02 381/184
7,174,990 B2 * 2/2007 Stead ..... G10K 13/00 181/157
2002/0057819 A1 5/2002 Czerwinski et al.
2005/0078850 A1 * 4/2005 Norton ..... H04R 7/14 381/423
2007/0047757 A1 * 3/2007 Yang ..... H04R 7/14 381/423
2009/0175487 A1 * 7/2009 Tsuchiya ..... H04R 7/14 381/425
2010/0158305 A1 * 6/2010 Funahashi ..... H04R 7/14 381/397
2010/0215196 A1 * 8/2010 Schulze ..... H04R 7/16 381/177
2010/0310112 A1 * 12/2010 Chen ..... H04R 7/14 381/433
2011/0129113 A1 * 6/2011 Kumakura ..... H04R 7/14 381/423

FOREIGN PATENT DOCUMENTS

GB 2086586 A 5/1982
WO 03009640 A2 1/2003

OTHER PUBLICATIONS

Search Report issued for GB Patent Application No. 1303514.2, mailed May 8, 2013.
Search Report issued for GB Patent Application No. 1309619.3, mailed Nov. 22, 2013.

* cited by examiner

ELECTRO ACOUSTIC DIAPHRAGM

CROSS-REFERENCE TO RELATED APPLICATION

This Application is a Section 371 National Stage Application of International Application No. PCT/EP2014/053217 filed Feb. 19, 2014 and published as WO/2014/131668 A1 on Sep. 4, 2014, in English, which claims priority to and benefits of GB Patent Application No. 1303514.2, filed Feb. 27, 2013, and GB Patent Application No. 1309619.3, filed May 30, 2013, the contents of which are hereby incorporated by reference in their entirety.

FIELD OF THE INVENTION

The present invention relates to a diaphragm for converting electrical signals into sound, such as a diaphragm for a compression driver loudspeaker, a direct radiating loudspeaker in the form of a closed loop, or a concentric drive loudspeaker.

BACKGROUND ART

In electro-acoustics there is a need for a system which simultaneously provides good quality high and low frequency bandwidths, whilst being relatively simple, robust, reliable and cheap. Maintaining the high frequency output of a compression driver requires a phase-plug closely spaced to the diaphragm to avoid an excessive acoustic compliance. The smaller this spacing the more extended the high frequency bandwidth will be. This phase plug to diaphragm spacing also limits the maximum diaphragm displacement since if the diaphragm contacts the phase plug gross distortion or even mechanical failure will occur. Since lower frequencies require larger volumes of air to be displaced, the smaller the phase plug spacing the less low frequency output is possible.

Consequently, increasing the low frequency output of a compression driver while simultaneously maintaining the high frequency bandwidth extension cannot be achieved by increasing the maximum diaphragm displacement.

In principle, increasing the size, and hence radiating area, of a diaphragm increases the low frequency output without reducing the high frequency bandwidth. However, practical diaphragms suffer non-pistonic vibrational modes at high frequencies which cause response irregularities and limit the usable high frequency bandwidth. Increasing the diaphragm size decreases the frequency of these modes thus limiting the diaphragm size possible for a particular material and geometry. Consequently, compression drivers of a similar size diaphragm and diaphragm material have similar limitations on acoustic output and bandwidth.

Conventional compression drivers with bandwidth extending to high frequencies fall into two main categories of diaphragm geometry. The diaphragm is either in the form of a spherical cap, or is an annular diaphragm which typically has a V-section, as in U.S. Pat. No. 6,804,370 and U.S. Pat. No. 5,878,148.

Annular diaphragms are usually only a centimeter or so wide and thus may be fabricated from lightweight material such as mylar film. The area is not as large as a spherical cap compression driver of the same diameter but extended high frequency response may readily be obtained.

Where extended bandwidth from one source is required, a coaxial configuration of two drivers is a somewhat complicated but viable option. In this configuration one large and one small diaphragm is driven through an electrical dividing network so the high frequencies are generated by the small diaphragm and the low frequencies by the large diaphragm. The output of the two diaphragms is combined using a complicated network of acoustic paths. Since the output of one diaphragm may travel down the entrance to the other diaphragm there are a number of additional acoustic resonances which may limit sound quality and bandwidth. The diaphragms also couple: the radiation from one causes the other to move. U.S. Pat. No. 5,878,148 teaches that the use of two annular diaphragms results in a compact design with relatively short acoustic channel lengths between the diaphragms and the manifold where the acoustical outputs are combined. However, even in this instance the acoustical interactions between the diaphragms are a significant limitation to the performance of coaxial drivers. None the less, this configuration is frequently preferred to a single large spherical cap type driver due to the poor sound quality resulting from structural resonances within the diaphragm, former and surround of the latter.

SUMMARY OF THE INVENTION

Accordingly the present invention provides a diaphragm for a loudspeaker, wherein the diaphragm is formed generally in a closed loop around a central void, the loop lying in a plane, the diaphragm having an axis in a direction orthogonal to the plane along which axis the diaphragm is arranged to be driven in use, the diaphragm having inner and outer circumferential edges which are adapted, in use, to be fixed in position, wherein a substantial portion of the diaphragm between the inner and outer edges is shaped in the direction of the said axis so as to protrude from the general plane of the diaphragm in either or both directions along the axis, wherein said protruding shaped portion when viewed along the direction of the axis comprises at least one series of curves and wherein the curves extend either substantially uninterruptedly across the majority of the radial distance between the inner and outer edges of the diaphragm, or across at least 90% of the radial distance between at least one of the inner and/or outer edges and a region, between the inner and outer edges of the diaphragm, which is configured for coupling to a coil for driving the diaphragm in the said direction.

For convenience, the present invention is principally described below with reference to a circular diaphragm in the form of a substantially planar ring with a central hole, however the invention applies equally to non-circular diaphragms, such as elliptical or race track shaped diaphragms, or any shape being symmetrical in two orthogonal directions lying in the general plane of the diaphragm and having a central hole. Accordingly, unless clearly indicated otherwise, any use in this description or in the claims of the terms "annular", "circumference", "circumferential", "circumferentially" or "around" should not be construed as being restricted to a circular shape, nor as necessarily being centred on a single axis but instead construed broadly as any substantially two-dimensional shape bounded by a closed loop. Similarly, the term "appears sinusoidal" should not be construed as limited to a strictly sinusoidal shape, but instead construed broadly as encompassing any substantially smooth series of substantially continuous and substantially cyclical, or rotationally periodic, curves.

The protruding, shaped portion may comprise a series of curves in the form of radial and circumferential modulations, which protrude axially from the general, or overall, surface of the diaphragm, and which greatly increase the geometric stiffness of the diaphragm in the axial direction while allowing circumferential stretch. Since the diaphragm is driven by an axisymmetric force there is little benefit in circumferential stiffness and it is the axial stiffness which determines the frequency of the modes. By controlling the depth, number and shape of the modulations the mode frequencies and shapes may be adjusted, in a manner which would be understood by those skilled in the art. Analysis has shown that by using sufficiently large modulations the diaphragm vibrational behaviour can be controlled to give a favourable acoustic output. This allows the use of a diaphragm with larger area, thus allowing a diaphragm providing extended high and low frequency bandwidth.

The diaphragm may comprise a surface region extending around a substantial part of the diaphragm, between the inner and outer edges of the diaphragm, and adapted and/or configured for coupling to a coil for driving the diaphragm in the direction of the axis, such as by glue or other adhesive. The surface region may extend circumferentially around the loop substantially uninterruptedly, and may be substantially axisymmetric, flat and/or substantially co-planar with the loop lying between inner and outer edges. This enables the diaphragm to be driven around substantially all of this circumferential region, which allows the reproduction of high frequencies and inhibits vibration round the circumference of the diaphragm. Alternatively, the diaphragm could be driven via the protruding, shaped portion using a suitably shaped voice coil drive bobbin, particularly if the protrusions were small, although assembly of such a driver/diaphragm arrangement would be difficult and might necessitate driving the diaphragm over only the parts of the circumferential region projecting towards the voice coil.

The shape of the diaphragm may be defined by a series of curves which in general follow contours of constant value in the direction of the axis, or of constant protrusion from the general plane of the diaphragm.

There may be two or more series of curves extending circumferentially around the diaphragm, at least one series of curves being disposed either side of the surface region for coupling to a drive or voice coil. The or each series of curves may extend substantially uninterruptedly around substantially the whole of the diaphragm.

A substantially planar portion may extend substantially uninterruptedly around the annular diaphragm adjacent the inner edge and/or outer edge thereof. Such planar portions act as hinges, and the protruding, shaped portions in between act as rigid links, hence the linearity of the restoring force may be controlled by altering the mean shape of the diaphragm and radial modulations. The or each planar portion may blend smoothly into the or each series of curves.

The shaped portion(s), or circumferential modulations, may comprise convolutions formed in the diaphragm; these convolution shapes may be in the form of a succession of substantially continuous curves, which may have a sinusoidal appearance. Where there are two or more circumferential series of curves, these may be in radial alignment. The convolutions protrude from the general plane of the diaphragm in either or both directions along the said axis; if the protrusion is away from the driving magnet only (i.e. in the direction of acoustic waves generated by the diaphragm), this avoids any impingement on the poles of the drive coil magnet, however protrusions in both directions would be feasible if there are sufficiently numerous convolutions. Generally, the number of convolutions is not critical to the quality of the sound generated by a loudspeaker using such a diaphragm, it being understood that an increase in their number can enable a decrease in their size in the axial direction and vice versa. Fewer modulations of the same height would be less satisfactory vibrationally, and a very small number of very tall modulations would be a problem since the radial stretch during manufacture would be too great; in practice, selection of the number of convolutions is likely to be a compromise between the factors of rigidity/strength, sound quality and ease of manufacture. The modulations are intended to remain substantially rigid in the axial direction in use, in order to increase axial stiffness of the diaphragm, while allowing a degree of circumferential stretch. The protrusions may be smooth, as this facilitates manufacture, or they may be smooth only where they blend in to the planar portions and otherwise present a sharp or discontinuous appearance when viewed in cross-section, as this is better acoustically.

We have found that having large areas of the diaphragm which are not shaped so as to protrude are undesirable, as such areas, even though useful as "hinges", can act as springs so that the rigid curved diaphragm acting as a mass can resonate on these. Accordingly, any unclamped planar regions at the outer and inner edges of the diaphragm, and the central surface region suitably comprise a minor part of the complete diaphragm; therefore the protruding shaped portion may comprise at least 60-70% of the radial width of the diaphragm, preferably at least 90% and more preferably 95%, and the curves (or the combined curves, where there are two or more series thereof) extend radially across substantially all of this shaped portion. To facilitate glue application and adhesion of the drive coil to the surface region, the surface region in the vicinity of the glue joint may be flat or it may be V-shaped, W-shaped or M-shaped in cross-section, however we have found that all these shapes lack radial stiffness (which is undesirable), and it is easier to eliminate or at least minimise this if the surface region is flat rather than V-shaped, W-shaped, M-shaped or any other shape.

The shape and configuration of the diaphragm is beneficial since, unlike conventional axisymmetric geometries, diaphragms in accordance with the invention do not rely on 'hoop strength' to provide the stiffness so it is possible to use non-axisymmetric geometries. For example, in another less simple manifestation the voice coil may be race track or elliptical. In this case the modulations are defined as perpendicular and tangential to the voice coil. A race track geometry is of particular use where a linear acoustic source is required. A further benefit of the new geometry is that, due to its smaller radii of curvature, it may be possible to use a thinner material while maintaining geometric stability during handling and manufacture.

Suitable materials for the diaphragm are titanium, aluminium, beryllium or plastic films such as polyether ether ketone (PEEK), polyethyleneimine (PEI), polyethylene naphthalate (PEN), polyimide (PI) or polyethylene terephthalate (PET), particularly biaxially-oriented PET such as that sold by EI du Pont Nemours & Co under the trade mark mylar. Titanium is beneficial because it is resistant to fatigue and has a high specific modulus, similar to Aluminium. Beryllium may also be suitable although it would be extremely expensive and fatigue might be a problem. The plastic films are likely to be useful for smaller diaphragms, where the low mass/area allows higher efficiency. PEEK is advantageous because of its thermal stability and accuracy of formed components.

In another aspect, the present invention also encompasses a loudspeaker incorporating a diaphragm as described herein, and to such a loudspeaker also comprising a phase plug which is complementarily-shaped with respect to the diaphragm. If the convolutions can be made sufficiently small and numerous, it would not be necessary acoustically for the phase plug surface to follow the convolutions of the diaphragm surface.

BRIEF DESCRIPTION OF THE DRAWINGS

Embodiments of the present invention will now be described by way of example, with reference to the accompanying figures in which.

DETAILED DESCRIPTION OF THE EMBODIMENTS

Figure 1:
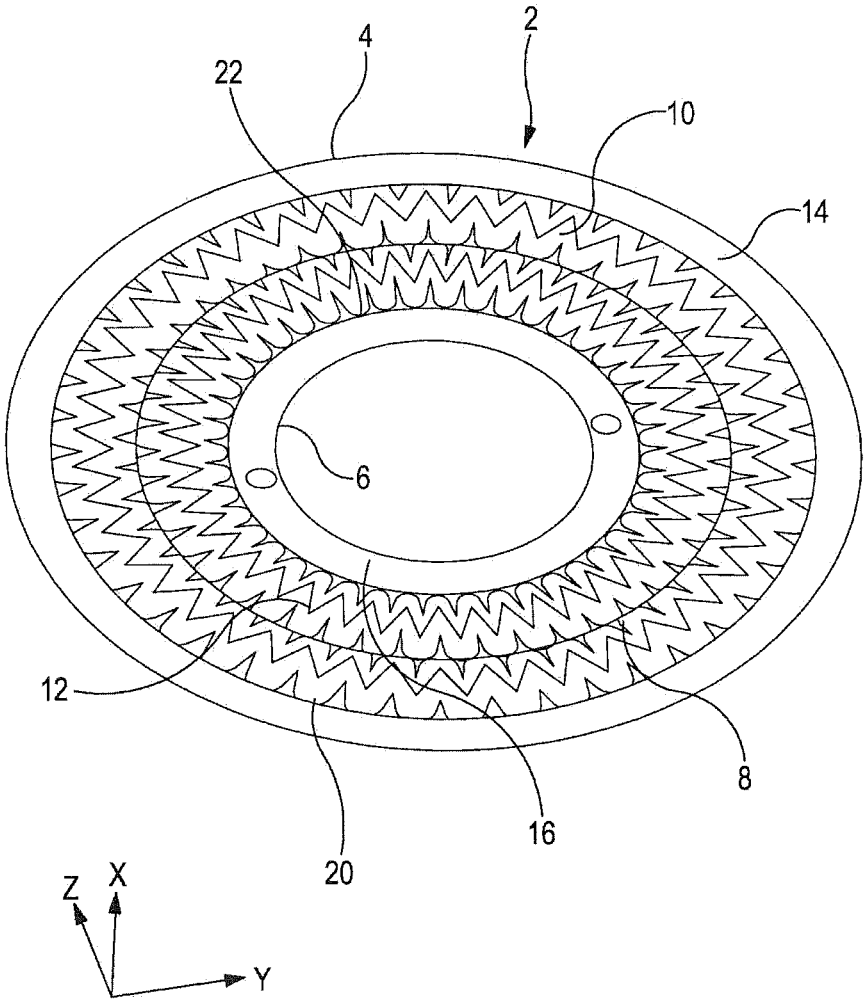
FIG. 1 is a perspective view of a diaphragm in accordance with the invention.

The diaphragm 2 shown in FIG. 1 lies generally in the Y-Z plane as illustrated, and is in the form of a thin ring, or annulus, with an outer circumferential edge 4 and an inner circumferential edge 6

Between the outer and inner edges is a planar circumferential portion 8 to which, in use, a drive coil (not shown) would be attached and arranged to drive the diaphragm in the X direction so as to generate acoustic waves; again, any shape or configuration would suit this portion 8 provided the drive coil can be easily attached thereto, such as V-shaped, M-shaped or W-shaped in cross-section, though in practice a substantially planar form is most easily manufactured. This portion 8 is in the region of the glue joint fixing the diaphragm 2 to the drive coil bobbin (shown in FIG. 3).

Either side of the circumferential portion 8 are a series of smooth circumferential modulations, or convolutions, formed in the thin diaphragm, so as to protrude from the general plane of the diaphragm in the X direction. Ignoring these modulations, the general, or overall, shape of the diaphragm between the outer edge 4 and the circumferential portion 8, and between the circumferential portion 8 and the inner edge 6, is substantially planar, and the circumferential portion 8 is shifted axially relative to the outer and/or inner edges 4,6 by a small amount (by about 0.1 mm in the 164 mm diameter diaphragm described below) to give the most linear variation of force with displacement of the diaphragm; preferably the axial shift is in the positive X direction (as shown in the drawings), although it may be beneficial in some arrangements for the shift to be in the opposite, negative X direction. Between the outer circumferential edge 4 and the outer modulations 10, and between the inner circumferential edge 6 and the inner modulations 12 are outer and inner planar regions 14, 16; a major portion of these regions is, in use, clamped so as to fix the diaphragm in position, the remaining, minor portion of these regions, indicated at 22,20, and located adjacent the outer circumference of the outer modulations 10 and adjacent the inner circumference of the inner modulations 12 function as hinges, allowing the modulations 10, 12 to remain as substantially rigid acoustic generators when the diaphragm is driven in the X direction. The circumferential portion 8 (the area of which is also small in relation to those of the inner and outer series of curves 10, 12) may also act as a hinge.

Figure 2:
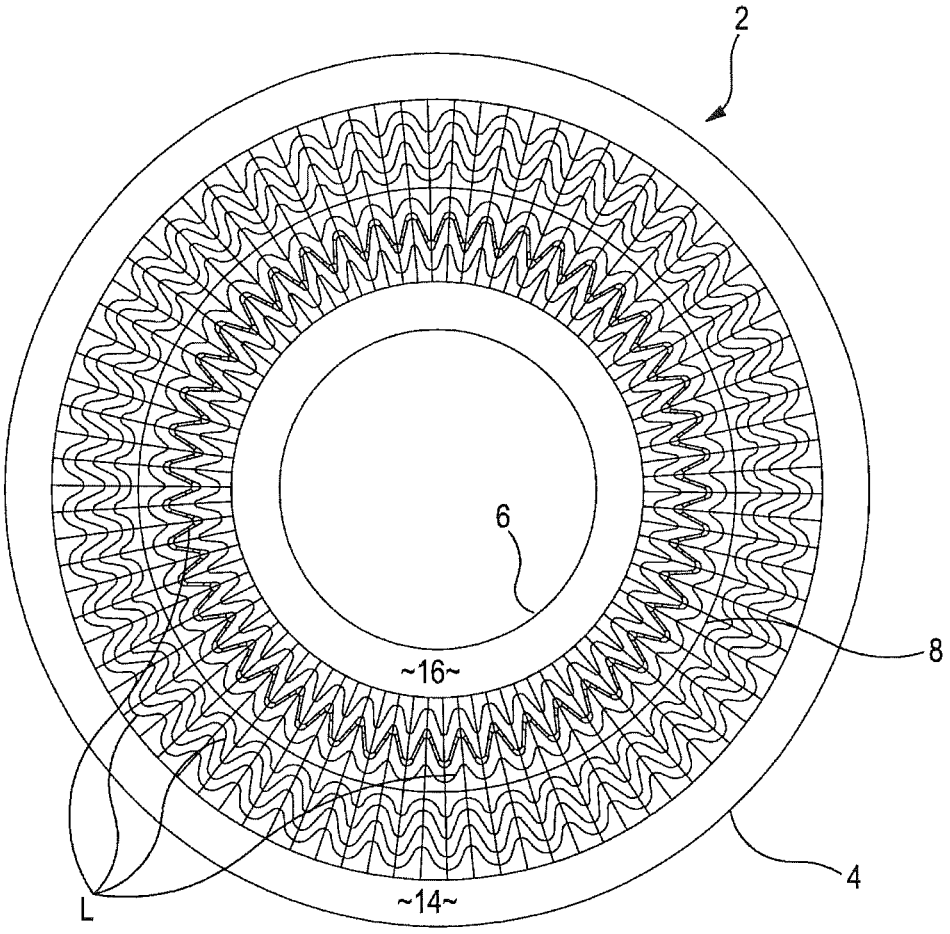
FIG. 2 is a plan view of the diaphragm of FIG. 1 showing curves on the diaphragm with equal axial value.

FIG. 2 shows the diaphragm 2 schematically in plan view, with the series of curves 10, 12 indicated by a number of contours L joining points equally positioned in relation to the X axis. Both the outer modulations 10 and the inner modulations 12 are shown in the form of a succession of continuous, periodic curves described circumferentially around the diaphragm at contours of axial value. Each of these series of curves, which appear sinusoidal, extends circumferentially around the diaphragm 2. As shown, the curves are in alignment, with the troughs and peaks of the inner series 12 and outer series 10 in radial alignment, however for some applications it may be preferable for the two series to be displaced so that the respective peaks and troughs are out of alignment. For some applications it may be favourable to have a different number of corrugations in the inner and outer series.

Figure 3:
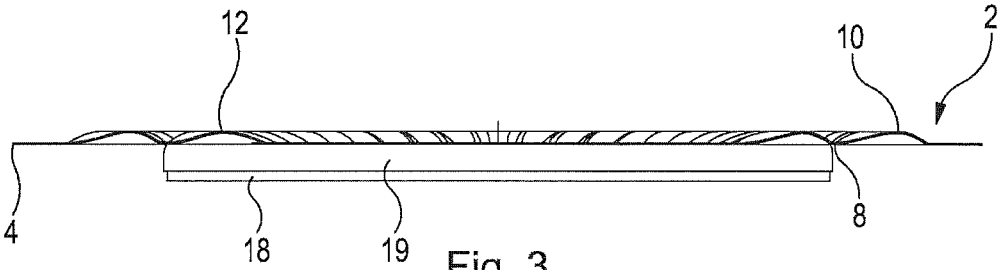
FIG. 3 is a cross-sectional view of the diaphragm of FIG. 1.
Figure 4:
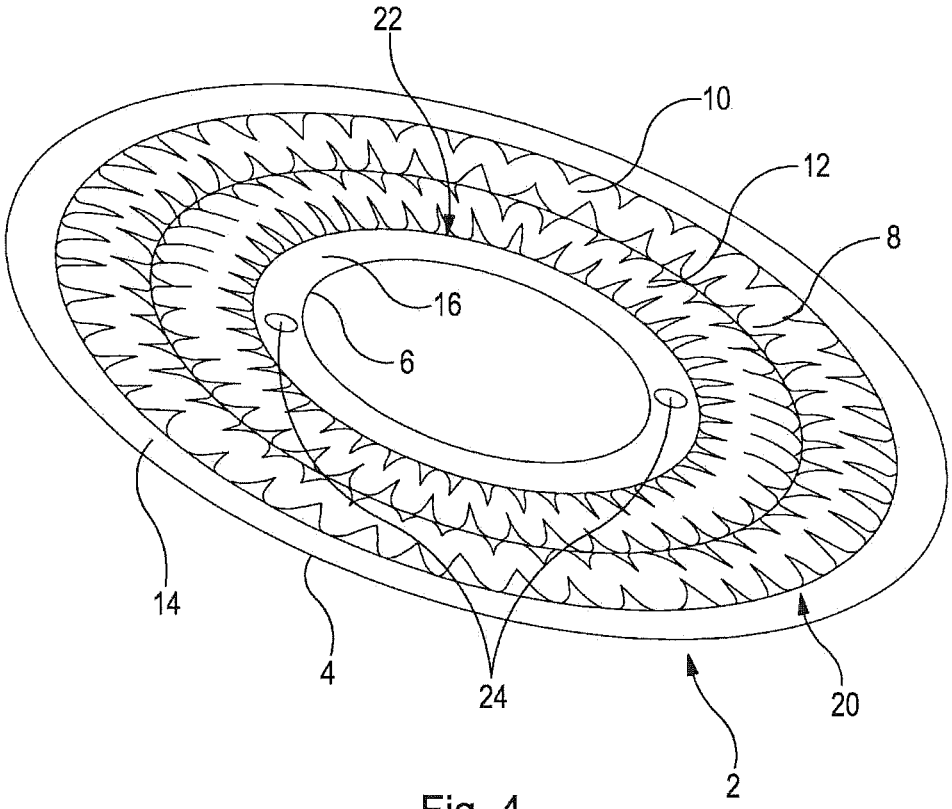
FIG. 4 is a schematic view similar to FIG. 1 but illustrating where the diaphragm may, in use, be fixed in position.

FIG. 3 shows the diaphragm 2 in cross-section, with a voice coil 18 connected at the circumferential portion 8 by means of a bobbin 19 for driving the diaphragm along the X axis FIG. 4 is a schematic view, showing where in use the diaphragm 2 is clamped in position. The outer and inner planar portions 14, 16 are shown darkly shaded; it is over these shaded areas that the diaphragm 2 is clamped. Barely discernible in the drawings are very small outer and inner planar portions which are not darkly shaded, indicated generally at 20, 22; these unshaded portions are continuations of the portions 14, 16, and in use are not clamped, so that they may act as hinges, as described above. It is these unshaded portions 20, 22, together with the modulations 10, 12, which comprise the moving portion of the diaphragm. It is this moving portion of the diaphragm 2, of which at least 90% as shown is shaped so as to protrude (in this actual diaphragm 95% is modulated more than 0.05 mm) and across substantially all of which moving portion the modulations extend in the radial direction—that is to say that the curves in the outer series of modulations 10 extends across substantially all of the radial distance between the outer planar portion 20 and the planar portion 8, and the curves in the inner series of modulations 12 extends across substantially all of the radial distance between the planar portion 8 and the inner planar portion 22. Given the ratio of radius to area, the curves therefore extend over at least about 97% or 98% of the radial distance between planar portions (or, in the example 5 inch (127 mm) diaphragm described below, at least 99.5%). Also shown in the inner planar portion 16 are two holes 24 in the diaphragm; these allow the diaphragm to be accurately positioned rotationally before the diaphragm is clamped in position for use.

The number and depth of the modulations or convolutions are generally inversely related, that is to say that as the number of convolutions is increased their depth can be reduced, and vice versa, and the sound quality should be approximately equivalent. In practice there will be limits which are largely dictated by the properties of the material from which the diaphragm is made and/or the manufacturing/forming process used: if there are too may convolutions, their profile becomes too small to be accurately made, and if there are too few convolutions their depth becomes greater than the material can be stretched.

We have found that diaphragms such as that illustrated in the Figures enable a high quality acoustic output with extended bandwidths at high and low frequencies simultaneously. For example, a diaphragm which we have constructed in accordance with the principles of this invention and which performs well acoustically has a series of sinusoidal curves, much as illustrated in the Figures, and is for use with a 5 inch (127 mm) drive coil; it has an outside diameter of 164 mm, a width (between the inside and outside diameter) of 38 mm, a modulation height (along the X axis) of about 2 mm and unclamped flat planar regions of 0.2 mm width (in the radial direction) or less. Those skilled in the art will appreciate how alternatively shaped and/or sized diaphragms may be constructed in accordance with the invention.

Although not shown, it will now be understood by those skilled in the art that the illustrated diaphragm could be used with a phase plug having a complementarily-shaped and/or configured surface adjacent the diaphragm, so as to maintain a suitably small distance between the phase plug and the diaphragm when the diaphragm is at rest, so that when the diaphragm is driven the volume of air enclosed can be kept sufficiently small to avoid loss of high frequency output due to acoustic compliance but to allow the diaphragm to move with the largest displacement to achieve maximum low frequency output, and give good acoustic performance without the diaphragm impinging on the phase plug.

Typically the phase-plug to diaphragm spacing is in the region of 0.1 mm-1.2 mm and the ratio of the effective diaphragm radiating area to phase-plug entrance area, also called compression ratio, is between 5 and 10. The mean flux at the voice coil is limited by the saturation of the iron poles and is between 1.2 Tesla and 2.1 Tesla depending on the magnet size and cost. The majority of conventional compression drivers use a titanium diaphragm and an aluminium voice coil, which is often copper clad to improve electrical connectivity. Preferably the height of the modulations in the diaphragm is a significant proportion of the airgap between the diaphragm and the phase plug, at least 25%.

It will of course be understood that many variations may be made to the above-described embodiment without departing from the scope of the present invention. For example, the or each series of curves could be interrupted, or only extend around parts of the circumference (though preferably any such interrupted arrangement would be symmetrical about the axis). Also, one or other of the series of curves could be omitted, or either or both could be formed in some other, essentially repetitive or rotationally periodic shape, such as one or more series of circular, elliptical, triangular or lozenge-shaped "dimples", or rows of dimples of any shape and/or of curved outline, or even pleats; the term "curves" used herein should be interpreted accordingly. It will be understood that, where the convolutions shown in the drawings are replaced by dimples, there will be a greater area between the dimples which could resonate, accordingly the proportional area of such a dimpled diaphragm which does not protrude in the axial direction will be greater than the 5% in the illustrated embodiment, up to about 30-40%. Just as with the two curved modulations, it is preferred that dimples extend across a majority of the entire radial distance between the planar hinge portions 20, 22, or between one or both of these portions and a planar portion 8, either in a single series, or loop, of dimples, or in two or more series. It may be practicable to reduce the radial extent, in the case where there is only a single series of curves, to a bare majority, i.e. just above 50%, although in practice the smaller the area which is modulated then the less effective the geometry. Where straight and/or tangential pleats are provided, there may be substantially no axially non-protruding regions, as the pleats adjacent the clamps merge into the clamps in a "roll", as is known in the art. The curved modulations or the dimples are most easily manufactured/formed by shaping a membrane which is initially flat and/or of uniform thickness, at the same time that the diaphragm is shaped to form the shallow M shape described above; alternatively, the modulations or dimples could be formed as protrusions on (or cavities in) the surface of such a membrane, which is then shaped to from the shallow M shape. A further dome or annular driver can be provided in the hole in the centre of the diaphragm, as will be appreciated by those skilled in the art. Also, the diaphragm has been described with reference to a unitary diaphragm, all formed of the same material, however it might be suitable in some applications for different materials to be used: for example, the planar sections which act as hinges and flex in use might be made of a material which is chosen for its resistance to fatigue or to get a lower modulus of elasticity, whereas the shaped portion(s) may be of a material chosen for its high modulus. Alternatively, the diaphragm might be made in two parts and arranged to be joined appropriately, such as along the region where there is a glue joint for joining the diaphragm to the drive coil bobbin. Whilst the outer and inner regions 14, 16 are described above as planar, and are shown as lying in substantially the same plane, it should be understood that the portions of these regions closest to the outer and inner circumferential edges 4, 6 might be non-planar (so as to facilitate the clamping of the diaphragm, for example), and that the outer and inner regions 14, 16 may be shifted axially by a small amount relative to each other without significantly detracting from the performance of the diaphragm. Furthermore, where different variations or alternative arrangements are described above, it should be understood that embodiments of the invention may incorporate such variations and/or alternatives in any suitable combination.

The invention claimed is:

1. A diaphragm for a loudspeaker, wherein the diaphragm is formed generally in a closed loop around a central void, the loop lying in a plane, the diaphragm having an axis in a direction orthogonal to the plane along which axis the diaphragm is arranged to be driven in use, the diaphragm having inner and outer circumferential edges which are adapted, in use, to be fixed in position, wherein a substantial portion of the diaphragm between the inner and outer edges is shaped in the direction of the said axis so as to protrude from the general plane of the diaphragm in either or both directions along the axis, wherein said shaped portion when viewed along the direction of the axis comprises at least one series of curves and wherein the at least one series of curves extend either substantially uninterruptedly across the majority of the radial distance between the inner and outer edges of the diaphragm, or across at least 90% of the radial distance between at least one of the inner and/or outer edges and a region, between the inner and outer edges of the diaphragm, which is configured for coupling to a coil for driving the diaphragm in the said direction.

2. A diaphragm according to claim 1 comprising a small planar region extending radially between the radial extremities of the at least one series of curves and the inner edge, outer edge and/or said region, said small planar region being, in use, unclamped.

3. A diaphragm according to claim 1 comprising a surface region extending around a substantial part of the loop, between the inner and outer edges of the diaphragm, and configured for coupling to a coil for driving the diaphragm in the said direction.

4. A diaphragm according to claim 3 wherein the surface region extends substantially uninterruptedly around the loop.

5. A diaphragm according to claim 3 wherein the surface region is flat and/or substantially co-planar with the loop.

6. A diaphragm according to claim 3 wherein there are two or more series of curves extending circumferentially around the diaphragm, at least one series of curves being disposed either side of the said surface region.

7. A diaphragm according to claim 1 wherein the at least one series of curves extends substantially uninterruptedly around substantially the whole of the diaphragm.

8. A diaphragm according to claim 1, further comprising a substantially planar portion extending substantially uninterruptedly around the diaphragm adjacent the inner edge thereof.

9. A diaphragm according to claim 1, further comprising a substantially planar portion extending substantially uninterruptedly around the diaphragm adjacent the outer edge thereof.

10. A diaphragm according to claim 8 wherein the planar portion blends smoothly into the or each series of curves.

11. A diaphragm according to claim 1 wherein the at least one series of curves comprises curved convolutions formed in the diaphragm.

12. A diaphragm according to claim 11 wherein the at least one series of curves is substantially continuous.

13. A diaphragm according to claim 11 wherein at least one each series of curves extends circumferentially around the whole of the loop.

14. A diaphragm according to claim 1 wherein the at least one series of curves is periodic.

15. A diaphragm according to claim 13 wherein the at least one series of curves are described about a closed loop on the surface of the diaphragm.

16. A diaphragm according to claim 15 wherein the at least one series of curves appear sinusoidal when viewed along the direction of the axis.

17. A diaphragm according to claim 1 wherein the diaphragm is generally annular.

18. A diaphragm according to claim 1 wherein the substantial portion comprises at least 70% of the surface area of the diaphragm.

19. A loudspeaker comprising a diaphragm according to claim 1.

20. A loudspeaker according to claim 19, further comprising a phase plug.

21. A loudspeaker according to claim 20, wherein the surface of the phase plug adjacent the diaphragm is shaped and configured so as, in use, acoustically to complement the or each surface region and/or shaped portion of the diaphragm.

* * * * *